US007151505B2

(12) United States Patent
Jostell et al.

(10) Patent No.: US 7,151,505 B2
(45) Date of Patent: Dec. 19, 2006

(54) QUADRIFILAR HELIX ANTENNA

(75) Inventors: Ulf Jostell, Molndal (SE); Mikael Ohgren, Partille (SE)

(73) Assignee: Saab Encsson Space AB, Gothenburg (SE)

( * ) Notice: Subject to any disclaimer, the term of this patent is extended or adjusted under 35 U.S.C. 154(b) by 0 days.

(21) Appl. No.: 11/160,137

(22) Filed: Jun. 10, 2005

(65) Prior Publication Data

US 2005/0275601 A1 Dec. 15, 2005

(30) Foreign Application Priority Data

Jun. 11, 2004 (EP) ..... 04013699

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS 5,346,300 A * 9/1994 Yamamoto et al. ..... 343/895
5,612,707 A 3/1997 Vaughan et al.
5,828,348 A 10/1998 Tassoudji et al.
6,011,524 A * 1/2000 Jervis ..... 343/895
6,094,178 A 7/2000 Sanford
6,154,184 A * 11/2000 Endo et al. ..... 343/895
6,172,656 B1 * 1/2001 Ohwada et al. ..... 343/895
6,184,844 B1 2/2001 Filipovic et al.
6,259,420 B1 7/2001 Bengtsson et al.
6,421,028 B1 * 7/2002 Ohgren et al. ..... 343/895
6,421,029 B1 * 7/2002 Tanabe ..... 343/895
6,424,316 B1 * 7/2002 Leisten ..... 343/895
6,433,755 B1 * 8/2002 Kuramoto ..... 343/895
6,480,173 B1 * 11/2002 Marino ..... 343/895
6,545,649 B1 * 4/2003 Seavey ..... 343/895
6,720,935 B1 * 4/2004 Lamensdorf et al. ..... 343/895

OTHER PUBLICATIONS

Shumaker P K et al: "A New GPS Quadrifilar Helix Antenna" IEEE Antennas and Propagation Society International Symposium 1996. Digest. Baaltimore , Jul. 21-26, 1996. Held in Conjunction With the USNC/URSI National Radio Science Meeting, New York, IEEE, US, vol. 3, Jul. 21, 1996, pp. 1966-1969, XP000755295 ISBN: 0-7803-3217-2.

* cited by examiner

*Primary Examiner*—Tan Ho
(74) *Attorney, Agent, or Firm*—Albihns Stockholm AB

(57) ABSTRACT

A quadrifilar helix antenna (1) comprising a first and a second set of helical antenna elements (2*a*–5*a*, 2*b*–5*b*) symmetrically arranged around a longitudinal axis extending through the axial center of the antenna (1). The antenna (1) is excited from feeding points (2*c*–5*c*) in a local ground plane at the bottom (6) of the antenna. The helical antenna elements (2*a*–5*a*) of the first set are interconnected in respective top ends of the elements at the top (7) of the antenna. The bottom ends of the first set are in galvanic contact with the respective feeding points (2*c*–5*c*). The antenna is characterized in that the top ends of helical antenna elements (2*b*–5*b*) of the second set are arranged in an open circuit and remain unconnected. The bottom ends of the helical antenna elements (2*b*–5*b*) of the second set each includes a connection (2*d*–5*d*) to the local ground plane.

13 Claims, 2 Drawing Sheets

QUADRIFILAR HELIX ANTENNA

FIELD OF THE INVENTION

The present invention relates to antennas. More specifically the present invention relates to quadrifilar helix antennas with a first and second set of helical antenna elements symmetrically arranged around a longitudinal axis extending through the axial center of the antenna. The antenna is excited from a feeding point in a local ground plane.

DESCRIPTION OF THE RELATED ART

A quadrifilar helix antenna typically consists of four symmetrically positioned helix shaped metallic wire of strip elements. The four helices are fed in phase quadrature, i.e. with equal amplitude and with the phase relation 0°, 90°, 180° and 270°. The quadrifilar helix antenna can receive and transmit circulary polarized signals over a large angular region. Its radiation characteristics are determined mainly by the shape of the helices, i.e. the number of turns, pitch angle, antenna height and antenna diameter, and in the cases of conical shaped helices also the cone angle.

Such antenna elements are known, with cylindrical or conical arrangement of the radiation members. These are typically fixed in space by winding them on some substrate of dielectric material, or by etching them on a substrate which is then formed—usually into a cylinder or cone.

The phase quadrature feeding of the four helices can be accomplished in different manners. One possibility is to have a separate feeding network that generates the phase quadrature. Alternatively a balun system can be used combined with a separate 90°-hybrid or with a self-phasing helix antenna.

Technical areas where such quadrifilar helix antennas are used are within the lower microwave bands, e.g. L-band up till X-band. The antennas are used to generate and receive normally wide-lobe circulary polarised radiation of hemispheric or isoflux character. Typical applications are antennas for satellites in TT&C-links and narrow band data links. Other applications are in GPS-receivers, both satellite based and ground based. Common for these applications is that a high antenna gain is desired within a wide area of coverage but that possible radiation outside of the covered area normally is disturbing for the system due to multipath propagation when the antenna is placed in its non-ideal surrounding. To verify system performance the antenna function must be measured and analyzed in its surrounding. This is both complicated and costly. An antenna whose performance is insensitive to the surroundings in which it has been placed is thus beneficial from several aspects.

Quadrifilar helix antennas for said applications are normally small, one to two wavelengths, which means that it may be difficult to excite the antenna without exciting the structure that the antenna is mounted on. This would cause undesired surface currents that would contribute to the antennas radiation diagram in an undesired way. This is particularly appearant outside the area of covereage in an area where normally low radiation levels are desired.

The helical antenna element in the quadrifilar helix antenna can be excited in the bottom of the antenna, where the helical antenna elements are attached to a ground plane, or in the opposite end, so called top-fed antennas. Both solutions are technically implemented. It is noticable that the top-feed antennas give rise to less back-lobe radiation. The reason for this is that the discontinuity that the electromagnetic field experiences at the feeding points inevitably give rise to currents on the local ground plane and therefore in the structure to which the antenna is attached.

However, a disadvantage with the top-fed antenna is that it is mechanically complex. Coaxial connectors are coupled to coaxial wires that extend through the base to the tip of the antenna. The coaxial wires to the top of the antenna need mechanical support. The wires may also have impact on the radiation function.

The bottom-fed antenna is sometimes arranged with self-supporting metallical helices. An alternative, more mechanically attractive and inexpensive solution that also exists is to etch the helical antenna elements on a thin dielectrical substrate that is formed into a cone or a cylinder. The helical antenna elements are connected to coaxial connectors in the ground plane of the antenna in both these instances.

There is no solution available that combines the low back-lobe radiation properties of a top-fed antenna with the mechanical advantages of a bottom-fed antenna.

SUMMARY OF THE INVENTION

The object of the present invention is therefore to provide a quadrifilar helix antenna, which offers an improvement over previous bottom-fed quadrifilar helix antennas and which offers low back-lobe radiation.

According to one aspect of the invention the object is achieved in a quadrifilar helix antenna comprising a first and second set of helical antenna elements symmetrically arranged around a longitudinal axis extending through the axial center of the antenna. The antenna is excited from a feeding point in a local ground plane. The helical antenna elements of the first set are interconnected in respective top ends of the elements in the main radiative top of the antenna. The feeding point is located at the bottom ends of the first set of helices. For the second set of antenna elements, the bottom ends of the elements are connected to the same local ground plane as the first set of antenna elements are fed through. However, the top ends of the second set of helical antenna are arranged in an open circuit and remain unconnected.

An important advantage attained by the antenna is that four virtual feeding points are established at the top of the helix antenna, thus eliminating the known disadvantages of a bottom-fed antenna.

In a specific embodiment of the invention the antenna elements in the first and second set are adjacent and arranged in pair. Thus, two-wire circuits are formed by an antenna element of the first set and a respective antenna element of the second set. Advantageously, each pair of antenna elements are arranged in the direction of a ray extending through the longitudinal axis of the antenna.

According to a preferred embodiment of the invention the first set of helical antenna elements are etched circuits on a first substrate formed as a first cylinder or a cone. The second set of helical antenna elements are etched circuits on a second substrate formed as a second cylinder or cone. The dimensions of the first cylinder or cone are less than those of the second cylinder or cone, which is arranged to embrace the first cylinder or cone.

Further advantages, advantageous features and applications of the present invention will be apparent from the following description and the dependent claims.

BRIEF DESCRIPTION OF THE DRAWINGS

The present invention will now be discussed in more detail with reference to the attached drawings.

EMBODIMENTS OF THE INVENTION

Figure 1:
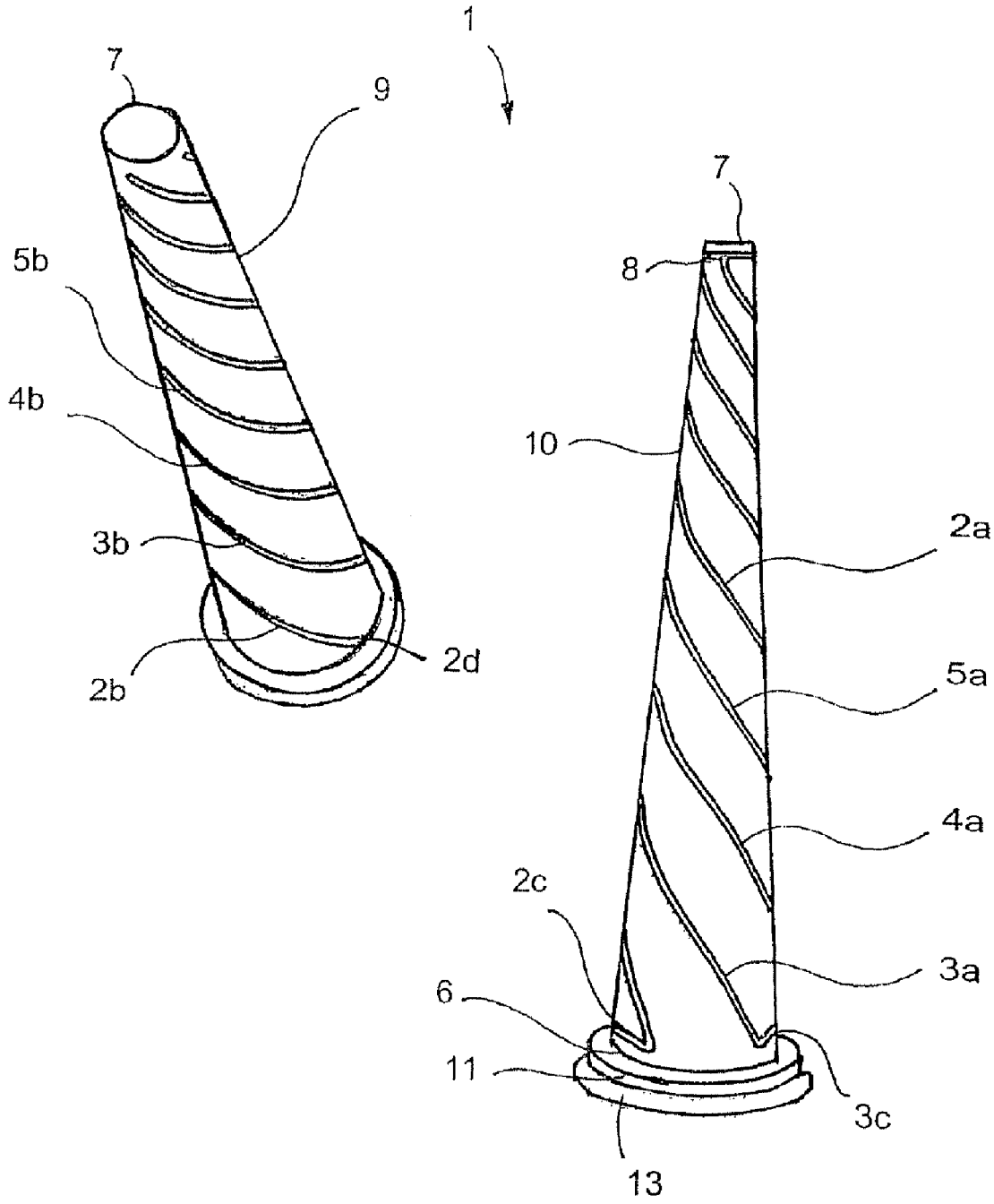
FIG. 1 is an exploded view of a preferred embodiment of the present invention.

FIG. 1 shows an exploded view of a frequency quadrifilar helix antenna 1 in accordance with the teachings of the invention. The antenna consists of four helix shaped radiating elements where each helix element 2–5 consists of two parallel helices 2*a,b*–5*a,b* of different lengths that are in galvanic contact. The antenna elements are made of metal, preferably aluminum, an alloy of beryllium or copper, titanium or steel. A feed network for feeding the antenna is arranged beneath the antenna elements. The four helices are fed in phase quadrature, i.e. with equal amplitude and with the phase relation 0°, 90°, 180° and 270°. Where the helices are fed and how the phase quadrature feedings is accomplished is not part of the invention and the feed network will not be described in more detail. The quadrifilar helix antenna is especially well adapted to transmit and receive circularly polarized radio frequency waves.

The antenna will in the following be described as having a first and a second set of helical antenna elements where each helix in the first set has a corresponding helix in the second set that form a pair of helices (2*a*,2*b*; . . . ;5*a*,5*b*). The first set of helical antenna elements 2*a*–5*a* are arranged in accordance with conventional teachings of prior art. The helix elements of the second set 2*b*–5*b* are shorted at the bottom of the antenna system to a local ground plane 6 so that each element of the second set have a connection 2*d*–5*d* to the local ground plane. The helix elements of the second set 2*b*–5*b* are open circuited at the top 7 of the antenna. Each pair of helices 2*a,b*; . . . ;5*a,b* constitutes a double circuit with feeding points 2*c*–5*c* in the local ground plane. The rf-field is distributed from the feeding points 2*c*–5*c* to the top 7 of the antenna. The first set of helices 2*a*–5*a* is, as opposed to the second set of helices 2*b*–5*b*, closed circuited at the top of the antenna. In order to maintain the correct distance between helix antenna elements in the self-supporting quadrifilar helix antenna, spacing elements of dielectric material may be attached to the helix antenna elements in each pair.

In the disclosed preferred embodiment of a quadrifilar helix antenna, the first set of helical antenna elements 2*a*–5*a* are etched on a first cone 10 and the second set of helical antenna elements 2*b*–5*b* are etched on a second cone 9 or cylinder. The base diameter of the first and second cone or cylinder differs slightly so that the two sets of antenna elements may be arranged adjacently by fitting the first 10 of the two cones or cylinders into the second cone 9. In another embodiment which is not disclosed in the figures, the second cone 9 is fitted into the first cone 10. The positions of each individual helix are adjusted so that the second set of helices 2*b*–5*b* is facing the first set of helices 2*a*–5*a*. Parameters that affect the antenna characteristics are chosen to achieve suitable impedance. Such parameters include the width of the helical antenna elements, the distance between each pair of helices and the base diameter of the cones or cylinders. The feeding points 2*c*–5*c* at the bottom of the inner, first set of helices 2*a*–5*a* are balanced and will not generate any currents on the ground plane which can give rise to back radiation.

At the top of the first cone 10, all helices in the first set of helices 2*a*–5*a* are connected by a galvanic interconnection 8. The galvanic interconnection 8 may be achieved by soldering or by some other form of electrically conducting assembly method so that a ring is obtained. A galvanic interconnection may also be achieved without having a closed ring if one end of the top substrate supporting the ring conductor is free. Each helix will see a virtual ground and hence the reflected current will change in phase by 180 degrees. The helices in the second set of helices 2*b*–5*b* remain open. The currents on the second set of helices on the outer, second cone 9 will not change in phase when they are reflected at the open top ends of the outer helices. The current in the first and second pair of helices will have the same phase and each pair of helices will now behave as the radiating elements.

The radiating elements or helices may in a preferred embodiment be made of etched copper strips on glass/epoxy cones. The two cones 9, 10 are extremely thin, about 0.1 mm and to improve mechanical performance the two helix cones may be bonded to each other at 16 places along the cones with the help of small glass and/or epoxy spacer elements. The top of the outer, second cone 9 may also be bonded to an external fiber glass radome. The cones or cylinders are separated by gas or vacuum. In order to increase the stability in the solution, it is also possible to include a dielectric spacing material in the space between the encompassing cone or cylinder and the inner cone or cylinder.

The bottom of each helix cone 6 may be bonded to an aluminum ring 11 which is fastened by means of screws into the antenna base 13. Other fastening means are of course also possible.

The inner helices are fed at the bottom in phase quadrature, i.e. with equal amplitude and with the phase relation 0°, 90°, 180° and 270°.

Figure 2:
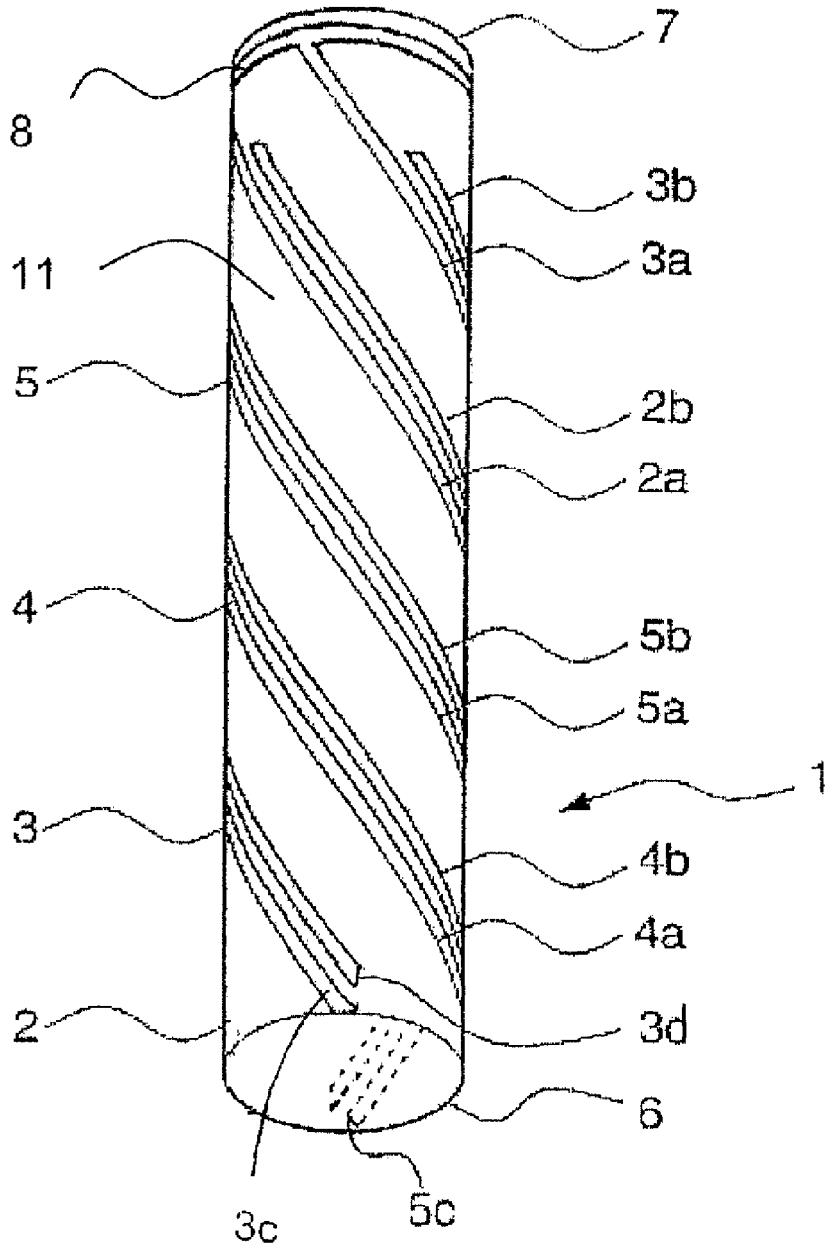
FIG. 2 is a perspective view of an alternative embodiment.

Another embodiment of the invention is disclosed in FIG. 2. In accordance with this embodiment, the two sets of helical antenna elements are etched on the same substrate 12 so that these elements form coplanar double or triple circuits. The coplanar double circuit consists of a first set of helical antenna elements 2*a*–5*a* that are interconnected at respective top ends of the elements and the bottom ends are fed through the local ground plane. For the second set of antenna elements 2*b*–5*b* the bottom ends of the elements each have a connection 2*d*–5*d* to the same local ground plane as the first set of antenna elements are fed through. However, the top ends of the second set of helical antenna remain unconnected. The two sets of helices are placed side by side as a coplanar transmission line supported by one dielectric cone or cylinder. The coplanar triple circuit is the same as the coplanar double circuit with the exception that a third set of helices is added. The third set of helices looks the same as the second set but is placed on the opposite side when seen from the first set of helices.

The foregoing description of the embodiments of the invention have been presented for purposes of illustration and description. It is not intended to be exhaustive or to limit the invention to the precise forms disclosed, since many modifications or variations thereof are possible in light of the above teaching. Accordingly, it is to be understood that such modifications and variations are believed to fall within the scope of the invention. It is therefore the intention that the following claims not be given a restrictive interpretation but should be viewed to encompass variations and modifications that are derived from the inventive subject matter disclosed.

What is claimed is:

1. A quadrifilar helix antenna comprising a first and a second set of helical antenna elements symmetrically arranged around a longitudinal axis extending through the axial center of the antenna, wherein the antenna is excited from feeding points in a local ground plane at the bottom of the antenna, the helical antenna elements of the first set are interconnected in respective top ends of the elements at the top of the antenna and the bottom ends of the first set are in galvanic contact with the respective feeding points, wherein the bottom ends of the helical antenna elements of the second set each have a connection to the local ground plane and that the top ends of helical antenna elements of the second set are arranged in an open circuit and remain unconnected.

2. A quadrifilar helix antenna in accordance with claim 1, wherein the first set of helices is enclosed by the second set of helices.

3. A quadrifilar helix antenna in accordance with claim 1, wherein antenna elements in the first and second set are adjacent and arranged in pairs so that two-wire circuits are formed by an antenna element of the first set and a respective antenna element of the second set.

4. A quadrifilar helix antenna in accordance with claim 1, wherein each pair of antenna elements are arranged in the direction of a ray extending through the longitudinal axis of the antenna.

5. A quadrifilar helix antenna in accordance with claim 1, wherein the top ends of the first set of antenna elements are interconnected by a galvanic interconnection.

6. A quadrifilar helix antenna in accordance with claim 1, wherein the first set of helical antenna elements are etched circuits on a first substrate formed as a first cylinder with a first diameter, the second set of helical antenna elements are etched circuits on a second substrate formed as a second cylinder with a second diameter that is larger than the first diameter, and wherein the second cylinder is arranged to embrace the first cylinder.

7. A quadrifilar helix antenna in accordance with claim 6, wherein the etched circuits on the respective substrates are arranged to overlap in an area in the vertical direction of the antenna.

8. A quadrifilar helix antenna in accordance with claim 6 wherein the two cylinders or cones are separated by gas or vacuum.

9. A quadrifilar helix antenna in accordance with claim 6 wherein the two cylinders or cones are separated by a spacing distance material.

10. A quadrifilar helix antenna in accordance with claim 1, wherein the first set of helical antenna elements are etched circuits on a first substrate formed as a first circular cone with first dimensions, the second set of helical antenna elements are etched circuits on a second substrate formed as a second circular cone with second dimensions that are larger than the first dimensions, and wherein the second cone is arranged to embrace the first cone.

11. A quadrifilar helix antenna in accordance with claim 1, wherein the first set of helical antenna elements and the second set of helical antenna elements are etched circuits on one substrate so that the antenna elements are co-planar circuits.

12. A quadrifilar helix antenna in accordance with claim 1, wherein the first and second set of helical antenna elements are self-supporting double helices.

13. A quadrifilar helix antenna in accordance with claim 12, wherein the antenna elements are locked into position by means of spacing elements.

* * * * *